US005912213A

United States Patent [19]

Baker et al.

[11] Patent Number: 5,912,213

[45] Date of Patent: Jun. 15, 1999

[54] SUBSTITUTED CARBOXYLIC ACYLATING AGENT COMPOSITIONS AND DERIVATIVES THEREOF FOR USE IN LUBRICANTS AND FUELS

[75] Inventors: Mark R. Baker, Lyndhurst; Jeffry G. Dietz, University Hts.; Richard Yodice, Mentor, all of Ohio

[73] Assignee: The Lubrizol Corporation, Wickliffe, Ohio

[21] Appl. No.: 08/870,112

[22] Filed: Jun. 5, 1997

[51] Int. Cl.[6] ..... C10M 159/12; C10L 1/18

[52] U.S. Cl. ..... 508/452; 508/222; 508/305; 508/496; 44/329; 44/330; 44/398

[58] Field of Search ..... 508/222, 305, 508/496, 452; 44/329, 330

[56] References Cited

U.S. PATENT DOCUMENTS

| | | | |
|---|---|---|---|
| 4,209,411 | 6/1980 | Winans et al. | 252/56 D |
| 4,552,677 | 11/1985 | Hopkins | 252/33.6 |
| 4,906,394 | 3/1990 | Gutierrez et al. | 252/51.5 A |
| 5,176,841 | 1/1993 | Wallfahrer et al. | 252/56 D |
| 5,441,653 | 8/1995 | Cleveland et al. | 252/34 |
| 5,696,060 | 12/1997 | Baker et al. | 508/222 |
| 5,696,067 | 12/1997 | Adams et al. | 508/476 |

FOREIGN PATENT DOCUMENTS

| | | |
|---|---|---|
| 0 759 435 A2 | 2/1997 | European Pat. Off. . |
| 0 759 443 A2 | 2/1997 | European Pat. Off. . |
| 0 759 444 A2 | 2/1997 | European Pat. Off. . |

*Primary Examiner*—Ellen M. McAvoy
*Attorney, Agent, or Firm*—Joseph P. Fischer; James L. Cordek

[57] ABSTRACT

Substituted carboxylic acylating agents formed by reacting an olefin with a carboxylic reactant are further reacted with α-β unsaturated carboxylic compositions to form substituted carboxylic acylating agents. The substituted carboxylic acylating agents are further reacted with various compounds to form especially dispersants for use in oil compositions.

22 Claims, No Drawings

SUBSTITUTED CARBOXYLIC ACYLATING AGENT COMPOSITIONS AND DERIVATIVES THEREOF FOR USE IN LUBRICANTS AND FUELS

FIELD OF THE INVENTION

This invention relates to reaction products of polyolefins with carboxylic reactants to form carboxylic reaction products. The carboxylic reaction products are further reacted with an α-β unsaturated acids or anhydrides to form substituted carboxylic acylating agent reaction products which may be further reacted to form salts, esters, or with polyamines to form dispersants.

BACKGROUND OF THE INVENTION

Numerous types of additives are used to improve lubricating oil and fuel compositions. Such additives include, but are certainly not limited to dispersants and detergents of the ashless and ash-containing variety, oxidation inhibitors, anti-wear additives, friction modifiers, and the like. Such materials are well known in the art and are described in many publications, for example, Smalheer, et al, "Lubricant Additives", Lezius-Hiles Co., Cleveland, Ohio, USA(1967); M. W. Ranney, Ed., "Lubricant Additives", Noyes Data Corp., Park Ridge, N.J., USA (1973); M. J. Satriana, Ed., "Synthetic Oils and Lubricant Additives, Advances since 1979, Noyes Data Corp., Park Ridge N.J., USA (1982), W. C. Gergel, "Lubricant Additive Chemistry", Publication 694-320-65R1 of the Lubrizol Corp., Wickliffe, Ohio, USA (1994); and W. C. Gergel et al, "Lubrication Theory and Practice" Publication 794-320-59R3 of the Lubrizol Corp., Wickliffe, Ohio, USA(1994); and in numerous United States patents, for example Chamberlin, II, U.S. Pat. No. 4,326,972, Schroeck et al, U.S. Pat. No. 4,904,401, and Ripple et al, U.S. Pat. No. 4,981,602. Many such additives are frequently derived from carboxylic reactants, for example, acids, esters, anhydrides, lactones, and others. Specific examples of commonly used carboxylic compounds used as intermediates for preparing lubricating oil or fuel additives include alkyl and alkenyl substituted succinic acids and anhydrides, polyolefin substituted carboxylic acids, aromatic acids, such as salicylic acids, and others. Illustrative carboxylic compounds are described in Meinhardt, et al, U.S. Pat. No. 4,234,435; Norman et al, U.S. Pat. No. 3,172,892; LeSuer et al, U.S. Pat. No. 3,454,607 and Rense, U.S. Pat. No. 3,215,707.

Many carboxylic intermediates used in the preparation of lubricating oil additives contain chlorine. While the amount of chlorine present is often only a very small amount of the total weight of the intermediate, the chlorine frequently is carried over into the carboxylic derivative which is to be used as an oil or fuel additive. For a variety of reasons, including environmental reasons, the industry has been making efforts to reduce or to eliminate chlorine from additives designed for use as lubricant or fuel additives.

Accordingly, it is desirable to provide low chlorine or chlorine free intermediates which can be used as such in fuels and lubricants or to prepare low chlorine or chlorine free derivatives thereof for use in lubricants and fuels. The present invention provides carboxylic compounds which meet this requirement.

B. B. Snider and J. W. van Straten, J. Org. Chem., 44, 3567–3571 (1979) describe certain products prepared by the reaction of methyl glyoxylate with several butenes and cyclohexenes. K. Mikamni and M. Shimizu, Chem. Rev., 92, 1021–1050 (1992) describe carbonyl-ene reactions, including glyoxylate-ene reactions. D. Savostianov (communicated by P. Pascal), C. R. Acad. Sc. Paris, 263, (605–7) (1966) relates to preparation of some α-hydroxylactones via the action of glyoxylic acid on oleins. M. Kerfanto et. al., C. R. Acad. Sc. Paris, 264, (232–5) (1967) relates to condensation reactions of α-α-di-(N-morpholino)-acetic acid and glyoxylic acid with olefins.

European patent publications of Feb. 26, 1997, EP 0759443, EP 0759444 and EP 0759435 assigned to the Lubrizol Corporation give details of the reactions of polyolefins (A) with specific carboxylic reactants (B) to produce various reaction products (C). These European patent publications are incorporated herein by reference in their entirety.

U.S. Pat. No. 4,654,435 describes the reactions of unsaturated organic compounds except rubber, said compounds having at least one carbon-carbon double bond, with organic compounds having a carboxyl group and an aldehyde group in the presence of a Lewis acid.

SUMMARY OF THE INVENTION

This invention is for (D), substituted carboxylic acylating agent reaction products and methods for producing said reaction products. The reaction products are formed by reacting optionally in the presence of an acidic catalyst, (A) an olefin with (B) a carboxylic reactant to produce (C), an olefin carboxylic adduct. The adducts so formed are further reacted with α-β unsaturated acids or anhydrides to product (D), said substituted carboxylic acylating agents.

(A) at least one olefinic compound of the general formula $$(R^1)(R^2)C{=}C(R^6)(CH(R^7)(R^8)) \quad \text{(I)}$$

wherein each of $R^1$ and $R^2$ is, independently, hydrogen or a hydrocarbon based group and each of $R^6$, $R^7$ and $R^8$ is, independently, hydrogen or a hydrocarbon based group provided that at least one is a hydrocarbon based group containing at least 7 carbon atoms and wherein (A) has $\overline{M}_n$ of about 300–20,000; with (B) at least one carboxylic reactant selected from the group consisting of compounds of the formula $$R^3C(O)(R^4)_nC(O)OR^5 \quad \text{(II)}$$

and compounds of the formula

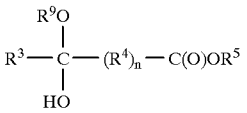

(III)

wherein each of $R^3$, $R^5$ and $R^9$ is independently H or a hydrocarbyl group, $R^4$ is a divalent hydrocarbylene group, and n is 0 or 1, wherein the ratio of reactants ranges from about 0.5 moles (B) per equivalent of (A), to about 3.0 moles (B) per equivalent of (A), wherein equivalents of (A) are defined hereinafter.

(C) Depending on the choice of reactants for (A) and (B) and their mole ratios, the products (C) comprise (IV) and (VI-A,B,C)) shown below and mixtures thereof. (VI-A,B,C) will be referred to herein only as (VI).

(IV)

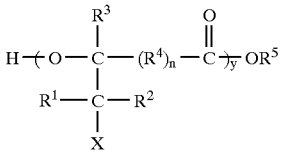

For olefin-carboxylate adduct (IV), the following meaning is given to the substituents:

each of $R^1$ and $R^2$ is H or a hydrocarbon based group, $R^3$ is H or hydrocarbyl;

$R^4$ is a divalent hydrocarbylene group;

n=0 or 1;

y is an integer ranging from 1 to about 200;

$R^5$ is H or hydrocarbyl; and

X is a group of the formula (V)

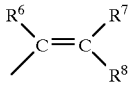

wherein each of $R^6$, $R^7$ and $R^8$ is independently H or a hydrocarbon based group, provided that at least one of $R^1$, $R^2$, $R^6$, $R^7$ and $R^8$ is a hydrocarbon based group containing at least 7 carbon atoms; and for (VI-A)

(VI-A)

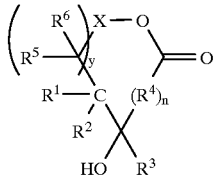

each of $R^1$ and $R^2$ is H or a hydrocarbon based group, $R^3$ is H or hydrocarbyl;

$R^4$ is a divalent hydrocarbylene group;

n=0 or 1;

y=0 or 1;

wherein X is a divalent hydrocarbyl group selected from the group consisting of $>C(R^6)(C(R^5)(R^7)(R^8))$ when y=0, and $>C(R^7)(R^8)$ when y=1

$R^5$ is H or hydrocarbyl; and each of $R^6$, $R^7$ and $R^8$ is independently H or a hydrocarbon based group, provided that at least one of $R^1$, $R^2$, $R^6$, $R^7$ and $R^8$ is a hydrocarbon based group containing at least 7 carbon atoms.

Other olefin-carboxylate adducts (C) formed from the reaction of (A) and (B) are regioisomers selected from the group consisting of compounds of the formula

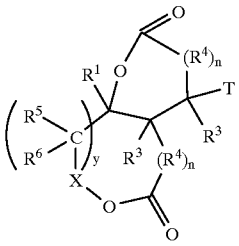

(VI-B)

and

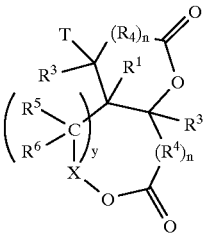

(VI-C)

wherein y=0 or 1, n=0 or 1 and X is a divalent hydrocarbyl group selected from the group consisting of $>C(R^6)(C(R^5)(R^7)(R^8))$ when y=0, and $>C(R^7)(R^8)$ when y=1, and T is selected from the group consisting of —OH and $R^5$. More often T is —OH.

Each $R^1$ is independently H or a hydrocarbon based group. In one particular embodiment, each $R^1$ is independently H or a lower alkyl group. As used herein, the expression "lower alkyl" refers to alkyl groups containing from 1 to 7 carbon atoms. Examples include methyl, ethyl and the various isomers of propyl, butyl, pentyl, hexyl and heptyl. In one especially preferred embodiment, each $R^1$ is H.

Each $R^3$ is independently H or hydrocarbyl. These hydrocarbyl groups are usually aliphatic, that is, alkyl or alkenyl, preferably alkyl, more preferably, lower alkyl. Especially preferred is where $R^3$ is H or methyl, most preferably, H.

Each $R^4$ is independently a divalent hydrocarbylene group. This group may be aliphatic or aromatic, but is usually aliphatic. Often, $R^4$ is an alkylene group containing from 1 to about 10 carbon atoms, more often from 1 to about 3 carbon atoms. The 'n' is 0 or 1; that is, in one embodiment, $R^4$ is present and in another embodiment, $R^4$ is absent. More often, $R^4$ is absent.

$R^5$ is H or hydrocarbyl. When $R^5$ is hydrocarbyl, it is usually an aliphatic group, often a group containing from 1 to about 30 carbon atoms, often from 8 to about 18 carbon atoms. In another embodiment, $R^5$ is lower alkyl, wherein "lower alkyl" is defined hereinabove. Most often, $R^5$ is H.

When at least one of $R^6$, $R^7$ and $R^8$ is a hydrocarbyl group, it preferably contains from 7 to about 5,000 carbon atoms. More often, such groups are aliphatic groups. In one embodiment, $R^6$ is an aliphatic group containing from about 10 to about 300 carbon atoms. In another embodiment, $R^6$ contains from 30 to about 100 carbon atoms and is derived from homopolymerized and interpolymerized $C_{2-18}$ olefins.

In a further embodiment, at least one of $R^7$ and $R^8$ is an aliphatic group containing from 10 to about 300 carbon atoms. Often, at least one of $R^7$ and $R^8$ contains from about 30 to about 100 carbon atoms and is derived from homopolymerized and interpolymerized $C_{2-18}$ olefins. The polymerized olefins are frequently 1-olefins, preferably ethylene, propylene, butenes, isobutylene and mixtures thereof. Polymerized olefins are frequently referred to herein as polyolefins.

In yet another embodiment at least one of $R^7$ and $R^8$ is an aliphatic group containing from 8 to about 24 carbon atoms. In another embodiment at least one $R^7$ and $R^8$ is an aliphatic group containing 12 to about 50 carbon atoms. Within this embodiment, most often one of $R^7$ and $R^8$ is H and the other is the aliphatic group.

In one preferred embodiment, each of $R^1$, and $R^3$ is independently hydrogen or a lower alkyl or alkenyl group.

In one especially preferred embodiment, each of $R^1$ and $R^3$ is hydrogen and each of y and n=0.

In another preferred embodiment, $R^6$ is an aliphatic group containing from about 8 to about 150 carbon atoms, $R^5$ is H, n is 0 and $R^3$ is H.

Reaction products (IV) and (VI) from (C) above are then fiter reacted with (VII), an α-β unsaturated acid or anhydride to produce said substituted carboxylic acylating agents (D). The preferred compounds for (VII) are illustrated by the formula:

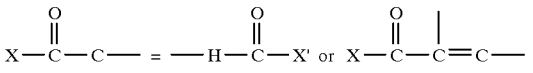

(VII)

where X and X' are either the same or different, provided that at least one of X or X' is such that (VII) when reacted with (C) to form (D), will allow (D) to function as a substituted carboxylic acylating agent. The preferred embodiments included for formula (VII) are maleic acid and maleic anhydride. A full discussion of the compositions encompassed by (VII) is found in U.S. Pat. No. 4,234,435 which is incorporated herein by reference in its entirety.

1. While maleic anhydride is the preferred α-β unsaturated compound (VII) to be reacted with (C), it should be clear that α-β unsaturated monocarboxylic acids or esters are also included, as are their derivatives, as suitable reactants to react with (C). The α-β unsaturated monocarboxylic acids and esters and derivatives thereof include the acrylic acid and ester type compounds among others.

2. The reactions of the α-β unsaturated compounds may either be thermal or radical initiated. Thermal will work only with an olefin structure such as (IV). Compounds of type (IV) will also react using radical initiated procedures. Compounds represented by (VI) do not contain olefin structures and will thus only react through radical processes. Radical induced reactions are disclosed in U.S. Pat. No. 5,122,507 and PCT Application WO 94/02571, both by the Chevron Company, which are hereby incorporated herein by reference for such disclosure. Any suitable free radical initiator may be used in the reactions disclosed above.

In general, the process of the present invention can be initiated by any free radical initiator for the reaction of (C) with said α-β unsaturated carboxylic compounds to (D). Such initiators are well known in the art. However, the choice of free radical initiator may be influenced by the reaction temperature employed.

Preferably, the half-life of the decomposition of the free radical initiator at the temperature of reaction will be in the range of about 5 minutes to 10 hours, more preferably, about 10 minutes to 5 hours, and most preferably, about 10 minutes to 2 hours.

The preferred free-radical initiators are the peroxide-type initiators and azo-type initiators.

The peroxide-type free-radical initiator can be organic or inorganic, the organic having the general formula: $R_3OOR_3'$ where $R_3$ is any organic radical and $R_3'$ is selected from the group consisting of hydrogen and any organic radical. Both $R_3$ and $R_3'$ can be organic radicals, preferably hydrocarbon, aroyl, and acyl radicals, carrying, if desired, substituents such as halogens, etc. Preferred peroxides include di-tert-butyl peroxide, tert-butyl peroxybenzoate, and dicumyl peroxide.

Examples of other suitable peroxides, which in no way are limiting, include benzoyl peroxide; lauroyl peroxide; other tertiary butyl peroxides; 2,4-dichlorobenzoyl peroxide; tertiary butyl hydroperoxide; cumene hydroperoxide; diacetyl peroxide; acetyl hydroperoxide; diethylperoxycarbonate; tertiary butyl perbenzoate; and the like.

The azo-type compounds, typified by alpha, alpha'-azobisisobutyronitrile (AIBN), are also well-known free-radical promoting materials. These azo compounds can be defined as those having present in the molecule the group —N═N wherein the balances are satisfied by organic radicals, at least one of which is preferably attached to a tertiary carbon. Other suitable azo compounds include, but are not limited to, p-bromobenzenediazonium floroborate; p-tolyldiazoaminobenzene; p-bromobenzenediazonium hydroxide; azomethane and phenyldiazonium halides. A suitable list of azo-type compounds can be found in U.S. Pat. No. 2,551,813, issued May 8, 1951 to Paul Pinkney.

The half-life values for known free radical initiators at various temperatures are readily available from the literature. See, for example, C. Walling, "Free Radicals in Solution", John Wiley and Sons, Inc., New York (1957). Alternatively, the half-life values are available from the various suppliers of free radical initiators, such as Witco, Atochem, Lucidol, Phillips Petroleum, and the like. Table 1 lists the half-life temperatures for a number of free radical initiators at a given half-life. The half-life temperature is the temperature required for a free radical initiator to exhibit a specified half-life. As a rule, the higher the half-life temperature, the lower the half-life of the free radical initiator.

TABLE 1

Half-Life Temperatures of Various Free Radical Initiators at Specified Half-Lives

| Initiator | Half-Life Temperature, ° C. 5 mins. | 10 mins. | 2 hrs. | 5 hrs. | 10 hrs. |
|---|---|---|---|---|---|
| DIALKYL PEROXIDES | | | | | |
| di-t-butyl peroxide | 173 | 166 | 143 | 135 | 129 |
| di-t-amyl peroxide | 167 | 160 | 137 | 129 | 123 |
| di-cumyl peroxide | 161 | 154 | 131 | 123 | 117 |
| 2,5-dimethyl-2,5-t-di(t-butyl-peroxy)hexane | 164 | 157 | 134 | 126 | 120 |
| PEROXYKETALS | | | | | |
| 1,1-di-tannylperoxycyclohexane | 134 | 128 | 106 | 99 | 93 |
| DIPEROXY CARBONATES | | | | | |
| di-ethylhexylperoxydicarbonate | 85 | 79 | 60 | 54 | 49 |
| DIACYL PEROXIDES | | | | | |
| didecanoyl peroxide | 102 | 96 | 76 | 69 | 64 |
| dibenzoyl peroxide | 114 | 108 | 86 | 78 | 73 |
| PEROXY ESTERS | | | | | |
| t-butyl-peroctoate | 115 | 109 | 90 | 82 | 77 |
| t-butyl perbenzoate | 152 | 144 | 119 | 110 | 104 |
| AZO COMPOUNDS | | | | | |
| AIBN | 105 | 98 | 78 | 72 | 65 |

The amount of initiator to employ depends to a large extent on the particular initiator chosen, the olefin used and the reaction conditions. The initiator should generally be soluble in the reaction medium. The usual concentrations of initiator are between 0.001:1 and 0.4:1 moles of initiator per mole of polyolefin reactant, with preferred amounts between 0.005:1 and 0.20:1.

In carrying out the process of the invention, a single free radical initiator or a mixture of free radical initiators may be employed. For example, it may be desirable to add an initiator having a low decomposition temperature as the mixture is warming to reaction temperature, and then add an initiator having a higher decomposition temperature as the mixture reaches higher reaction temperatures. Alternatively, a combination of initiators could both be added prior to heating and reaction. In this case, an initiator having a high decomposition temperature would initially be inert, but would later become active as the temperature rose.

The initiator may also be added over time. For example, if an initiator is chosen with a short half-life, e.g., 5–20 minutes, at the reaction temperature, then the initiator may be added over a period of time so that an adequate concentration of free radicals will be available throughout the reaction period to give improved yields of the desired product.

In general, after the reaction is deemed complete, for example, by NMR analysis, the reaction mixture is heated to decompose any residual initiator. For a di(t-butyl) peroxide initiator, this temperature is typically about 160° C. or higher.

In reacting (VII) with reaction products represented (IV) and (VI) to form substituted acylating agent (D), the ratio of (VII) to reaction products is 0.1–10 on a molar basis. More preferably the ratio is 0.5–3. The molecular weight of (IV) and (VI) can be calculated from the molecular weight of the reactants (A) and (B) used to form (IV) and (VI).

The substituted acylating agents (D) of this invention may be used as such in lubricants or fuels, or they may be further reacted with reactants as recited below to form further reaction products (E) of substituted acylating agent (D). The reactant is selected from the group consisting of (a) amine characterized by the presence within its structure of at least one H—N<group, (b) alcohol, (c) reactive metal or reactive metal compound, (d) a combination of two or more of any (a) through (c), the components of (d) being reacted with said substituted acylating agent either sequentially or simultaneously in any order. Ammonia and hydrazine are included in the above reactant groups. For a full disclosure of reactions of substituted acylating agents with (a)–(d) above we incorporated herein by reference U.S. Pat. No. 4,234,435.

Suitable reactants, to further react with (D) to form (E) include ammonia, hydrazines, monoamines or polyamines. The reactants must contain at least one N-H group.

The monoamines generally contain from 1 to about 24 carbon atoms, preferably 1 to about 12, and more preferably 1 to about 6. Examples of monoamines useful in the present invention include primary amines, for example methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary monoamines will not result in formation of an amide, but can form salts with carboxylic acids.

In another embodiment, the monoamine may be a hydroxyamine. Typically, the hydroxyamines are primary or secondary amines or mixtures thereof. As stated above, tertiary monoamines will not react to form amides; however tertiary alkanol monoamines sometimes can react to form a tertiary amino group containing ester. Hydroxy amines that can react to form amide can be represented, for example, by the formulae:

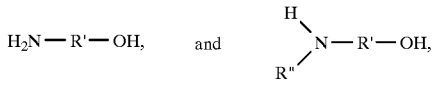

wherein each R" is independently a hydrocarbyl group, preferably alkyl or alkenyl, of one to about 22 carbon atoms or a hydroxyhydrocarbyl group, preferably aliphatic, of two to about 22 carbon atoms, preferably one to about four, and R' is a divalent hydrocarbyl group, preferably an alkylene group, of about two to about 18 carbon atoms, preferably two to about four. Typically, each R" is independently a methyl, ethyl, propyl, butyl, pentyl or hexyl group. The group —R'—OH in such formulae represents the hydroxyhydrocarbyl group. R' can be acyclic, alicyclic or aromatic. Typically, R' is an acyclic straight or branched alkylene group such as an ethylene, 1,2-propylene, 1,2-butylene, 1,2-octadecylene, etc.

Examples of these alkanolamines include mono- and diethanolamine, 2-(ethylamino)ethanol, 2-(butylamino) ethanol, etc.

Hydroxylamine ($H_2N$—OH) is a useful condensable monoamine.

The hydroxyamines can also be ether-containing N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

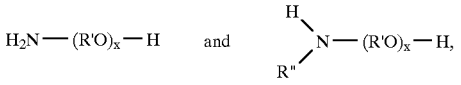

wherein x is a number from about 2 to about 15 and $R^4$ and R' are as described above. R" may also be a hydroxypoly (hydrocarbyloxy) group.

Other useful amines include ether amines of the general formula $$R^aOR'NHR^b$$

wherein $R^a$ is a hydrocarbyl group, preferably an aliphatic group, more preferably an alkyl group, containing from 1 to about 24 carbon atoms, R' is a divalent hydrocarbyl group, preferably an alkylene group, containing from two to about 18 carbon atoms, more preferably two to about 4 carbon atoms and $R^b$ is H or hydrocarbyl, preferably H or aliphatic, more preferably H or alkyl, more preferably H. When $R^b$ is not H, then it preferably is alkyl containing from one to about 24 carbon atoms. Examples of ether amines include, but are not limited to, hexyloxypropylamine, dodecyloxypropylamine, octyloxypropylamine, and N-decyloxypropyl-1,3-diamino propane. Ether amines are available from Tomah Products, Inc. and under the name SURFAM produced and marketed by Sea Land Chemical Co., Westlake, Ohio.

The amine may be an amino heterocycle. Examples include aminopyridine, aminopropylimidazole, aminopyrimidine, amino-mercaptothiadiazoles, and aminotriazole.

The amine may also be a polyamine. The polyamine contains at least two basic nitrogen atoms and is characterized by the presence within its structure of at least one HN<group. Mixtures of two or more amino compounds can be used in the reaction. Preferably, the polyamine contains at least one primary amino group (i.e., —$NH_2$) and more preferably is a polyamnine containing at least two condensable —NH— groups, either or both of which are primary or secondary amine groups. The polyamine may be aliphatic, cycloaliphatic, heterocyclic or aromatic. Examples of the polyamines include alkylene polyamines, hydroxy containing polyamines, arylpolyamines, and heterocyclic polyamines.

Among the preferred polyamines are the alkylene polyamines, including the polyalkylene polyamines. The alkylene polyamines include those conforming to the formula

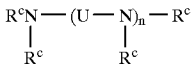

wherein n is from 1 to about 10; preferably about 2 to about 7, more preferably about 2 to about 5, each U is independently hydrocarbylene, preferably alkylene having from 1 to about 10 carbon atoms, often from about 2 to about 6, more preferably from about 2 to about 4 carbon atoms, each $R^c$ is independently a hydrogen atom, a hydrocarbyl group, preferably aliphatic, or a hydroxy-substituted or amine-substituted hydrocarbyl group, preferably aliphatic, having up to about 30 atoms, or two $R^c$ groups on different nitrogen atoms can be joined together to form a U group, with the proviso that at least one $R^c$ group is hydrogen. Preferably U is ethylene or propylene. Especially preferred are the alkylene polyamines where each $R^c$ is hydrogen, lower alkyl, or an aminosubstituted hydrocarbyl group, preferably aliphatic, with the ethylene polyamines and mixtures of ethylene polyamines being the most preferred.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are ethylene diamine, diethylene triamine, triethylene tetramine, tris-(2-aminoethyl)amine, propylene diamine, trimethylene diamine, tripropylene tetramine, tetraethylene pentamine, hexaethylene heptamine, pentaethylenehexamine, aminoethyl piperazine, dimethyl aminopropylamine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. The mixtures are particularly useful. On the other hand, quite satisfactory products can be obtained by the use of pure alkylene polyamines. Ethylene polyamine mixtures are useful.

Other useful types of polyamine mixtures are those resulting from stripping of the above-described polyamine mixtures removing lower molecular weight polyamines and volatile components to leave as residue what is often termed "polyamine bottoms". In general, alkylene polyamine bottoms can be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample showed it contains about 0.93% "Light Ends" (most probably diethylene triamine), 0.72% triethylene tetramine, 21.74% tetraethylene pentamine and 76.61% pentaethylene hexamine and higher (by weight). These alkylene polyamine bottoms include cyclic condensation products such as piperazine and higher analogs of diethylenetriamine, triethylenetetramine and the like.

In another embodiment, the polyamines are hydroxy-containing polyamines provided that the polyamine contains at least one condensable —N—H group. Hydroxy-containing polyamine analogs of hydroxy monoamines, particularly alkoxylated alkylenepolyamines can also be used. Typically, the hydroxyamines are primary or secondary alkanol amines or mixtures thereof. Such amines can be represented by mono- and poly-N-hydroxyalkyl substituted alkylene polyamines wherein the alkylene polyamines are as described hereinabove; especially those that contain two to three carbon atoms in the alkylene radicals and the alkylene polyamnine contains up to seven amino groups. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-di-(2-hydroxyethyl)-ethylenediamine, 1-(2-hydroxyethyl) piperazine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

The polyamines may be polyoxyalkylene polyamines, including polyoxyethylene and polyoxypropylene diamines and the polyoxypropylene triamines having average molecular weights ranging from about 200 to about 2000. Polyoxyalkylene polyamines are commercially available, for example under the tradename "Jeffamines" from Texaco Chemical Co. U.S. Pat. Nos. 3,804,763 and 3,948,800 contain disclosures of polyoxyalkylene polyamines and are incorporated herein by reference for their disclosure of such materials.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylnorpholines, N-aminoalkylthiomorpholines, N-aminoalkylpiperazines, N,N'-bisaminoalkyl piperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy alkyl substituted heterocyclic polyamines are also useful. Examples include N-hydroxyethylpiperazine and the like.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene) ethylenediamine; N-poly(propylene)trimethylenediamine; N-poly (butene)diethylenetriamine; N',N'-poly(butene) tetraethylenepentamine; N,N-dimethyl-N'-poly-(propylene)-1,3-propylenediamine and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an n (number average molecular weight) value of at least about 500. Generally, the polyalkene substituted amine is characterized by an n value of about 500 to about 5000, preferably about 800 to about 2500. In another embodiment n varies between about 500 to about 1200 or 1300.

The polyalkenes from which the polyalkene substituted amines are derived include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

Another useful polyamine is a condensation product obtained by reaction of at least one hydroxy compound with at least one polyamine reactant containing at least one primary or secondary amino group. These condensation products are characterized as being a polyamine product having at least one condensable primary or secondary amino group, made by contacting at least one hydroxy-containing material (b-i) having the general formula $$(R)_nY_z—X_p—(A(OH)_q)_m \quad (I)$$

wherein each R is independently H or a hydrocarbon based group, Y is selected from the group consisting of O, N, and S, X is a polyvalent hydrocarbon based group, A is a polyvalent hydrocarbon based group, n is 1 or 2, z is 0 or 1, p is 0 or 1, q ranges from 1 to about 10, and m is a number ranging from 1 to about 10; with (b-ii) at least one amine having at least one N—H group.

The hydroxy material (b-i) can be any hydroxy material that will condense with the amine reactants (b-ii). These hydroxy materials can be aliphatic, cycloaliphatic, or aromatic; monools and polyols. Aliphatic compounds are preferred, and polyols are especially preferred. Highly preferred are amino alcohols, especially those containing more than one hydroxyl group. Typically, the hydroxy-containing material (b-i) contains from 1 to about 10 hydroxy groups.

Monools useful as (b-i) are primary or secondary, preferably alkyl, monohydric compounds, preferably containing from 1 to about 100 carbon atoms, more preferably up to about 28 carbon atoms. Examples include methanol, ethanol, butanols, cyclohexanol, 2-methylcyclohexanol, isomeric octanols and decanols, octadecanol, behenyl alcohol, neopentyl alcohol, benzyl alcohol, beta-phenylethyl alcohol, and chloroalkanols.

Further examples are monoether- and polyether-containing monools derived from oxyalkylation of alcohols, carboxylic acids, amides, or phenolic materials, by reaction with alkylene oxides. When two or more different alkylene oxides are employed, they may be used as mixtures or consecutively, as discussed in greater detail hereinbelow. These ether-containing monools can be represented by the general structure:

$$R\text{-}(OR^d)_a\text{-}(OR^e)_b\text{-}(OR^f)_c\text{-}OH$$

wherein R=hydrocarbyl, acyl, or carboxamidoalkyl; preferably containing from 1 to about 28 carbon atoms, each of $R^d$, $R^e$ and $R^f$ is hydrocarbylene containing from 2 to about 12 carbon atoms, more often 2 or 3 carbon atoms; a, b, and c=0–100, provided that the total of a, b, and c is at least 1. When R is hydrocarbyl, it may be alkyl-, aryl-, arylalkyl-, or alkylaryl-. In one embodiment, a and b may from zero to about 12, preferably from zero to about 6, while in another embodiment, a and b range up to about 100.

Examples include 2-alkoxyethanols, members of the "Cellosolve" family of glycol ethers made by Union Carbide Corporation, and 2-(polyalkoxy)ethanol. Other commercially available products of alcohol alkoxylation include Neodol ethoxylated linear and branched alcohols from Shell Chemical, Alfonic ethoxylated linear alcohols from Vista Chemical, propoxylated alcohols from ARCO Chemicals, UCON® propoxylated alcohols from Union Carbide, Provol propoxylated fatty alcohols from Croda Chemical, and Carbowax methoxy polyethylene glycols, such as Carbowax® 350 and 750 from Union Carbide.

Aryl analogs of lower ether-containing monools include, for example, 2-(nonylphenoxyethyloxy)ethanol, 2-(octylphenoxyethyl-oxyethyloxy)ethanol and higher homologs made using greater amounts of alkylene oxides, marketed under the TRITON® trademark by Union Carbide.

As noted hereinabove, polyether monools may also be prepared by condensation of 2 or more different alkylene oxides, in mixtures or consecutively, with alcohols, alkylphenols or amides. Commercially available polyether monools made from reaction of mixtures of ethylene oxide and propylene oxide with butanol are represented by the UCON® 50-HB- and 75-HB-series of functional fluids from Union Carbide, while similar products from mixtures of propylene oxide and higher (e.g., $C_4$–$C_{10}$) alkylene oxides are sold by BP Chemicals under the Breox® tradename.

Polyols are defined herein as compounds containing at least two hydroxy groups.

Dihydroxy compounds include alkylene glycols of general structure HO—(—R—)—OH, wherein R is hydrocarbylene. Examples are ethylene glycol, 1,2-propanediol, 1,2-, 1,3- and 1,4-butylenediols, 1,6-hexanediol, neopentylene glycol, 1,10-decanediol, cyclohexane-1,4-diol and 1,4-bi-(hydroxymethyl) cyclohexane.

Other diols include ether-diols and polyether diols (glycols). These may be represented by the general structure:

$$HO\text{-}(OR^d)_a\text{-}(OR^e)_b\text{-}(OR^f)_cOH$$

wherein $R^d$, $R^e$ and $R^f$ are independently $C_2$–$C_{12}$ hydrocarbylene, more often ethylene or propylene, and a, b and c are independently zero to about 100, provided that the total of a, b, and c is at least 1. Examples of ether- and polyether- diols are diethylene glycol, triethylene glycol, tetraethylene glycol, dipropylene glycol, 2-(2-hydroxyethyloxy)-1-propanol and 1,2-bis-(2-hydroxypropyloxy)ethane, polyoxyalkylene oxides of the Carbowax® family of polyethylene glycols from Union Carbide, the Pluronic® P-series of polypropylene oxide diols from BASF, polyoxybutylene glycols from Dow Chemical, and the like.

In addition to monools and diols, other useful alcohols include polyhydric alcohols having three or more HO— groups, preferably those containing up to about 12 carbon atoms, and especially those containing from about 3 to about 10 carbon atoms. Useful polyhydric polyols include, glycerol, trimethylol propane, 2-ethyl-2-hydroxymethyl-1,3-propanediol, erythritol, pentaerytritol, dipentaerythritol, glucose, arabinose, 1,2,3-hexane triol, 2,3,4-hexanetriol, butanetriols, and polyglycerols (including the ether-coupled glycerol dimer, trimer, tetramer, etc.)

Amino alcohols are useful hydroxy containing compounds. Amino alcohols may be aliphatic, cycloaliphatic or aromatic, containing at least one hydroxy group and preferably containing two or more hydroxy groups. These may be prepared by methods known in the art, for example, by reaction of an amine having at least one N—H group with an alkylene oxide. Another procedure is to condense an aldehyde, particularly formaldehyde, with a nitro compound followed by reduction of nitro groups.

Useful amino alcohols include monoamino and polyamino compounds. These may be monohydroxy or polyhydroxy compounds, depending, for example on the extent of reaction with alkylene oxide. For example, a primary amine may react with one or two alkylene oxides, forming mono- or di-hydroxyalkylamines. Polyalkoxy ether containing amino alcohols are also useful. These may be prepared by reaction of ammonia or a primary or secondary amine with an excess of alkylene oxide.

Some of the more useful amino alcohols are the reduced condensation products of formaldehyde with nitroalkanes. Particularly useful are 2-amino-2-(2-hydroxymethyl)-1,3-propane-diol (commonly known as "THAM", or "TrisAmino"), 2-amino-2-ethyl-1,3-propanediol, and 2-amino-2-methyl-1 ,3-propanediol.

Examples of other useful amino alcohols include N-(N)-hydroxy-lower alkyl) amines and polyamines such as di-(2-hydroxyethyl) amine, aminoethanol, triethanolamine, dibutylaminoethanol, tris(hydroxypropyl)amine, N,N,N',N'-tetra-(hydroxyethyl)trimethylene-diamine, and the like.

Examples of commercially available oxyalkylated amines include members of the Ethomeen® and Propomeen® series of ethoxylated and propoxylated primary and secondary amines from AKZO Chemie. Ethylene diamine/propylene oxide products constitute the Tetronic® family of polyoxyalkylated diamine available from BASF/Wyandotte Corporation.

Reaction of ethylene oxide or propylene oxide with polyglycolamine from Union Carbide gives the corresponding di-(2-hydroxyalkyl)-ether amine. Similar reaction of these alkylene oxides with Jeffamine polyoxypropylamines from Huntsman Chemical results in the formation of N-hydroxyalkylated derivatives. Corresponding products may be made by hydroxyalkylation of 3-(higher alkyloxy) propylamines.

Other usefull hydroxy-containing reactants are hydroxyalkyl-, hydroxyalkyl oxyalkyl-, and corresponding aryl derivatives thereof, sulfides of the formula $$R\text{—}S_a\text{-}(R^dO)_bH$$

wherein R is a hydrocarbyl or hydroxyhydrocarbyl group containing from 1 to about 22 carbon atoms, $R^d$ is a hydrocarbylene group containing 2 to 12 carbons, a is 1 or 2; and b ranges from 1 to about 20. Examples include 2-(dodecylthio)ethanol, thiodiethanol, and 2-hydroxyethyl disulfide.

The hydroxy compounds are preferably polyhydric alcohols and amines, preferably polyhydric amines. Polyhydric amines include any of the above-described monoamines reacted with an alkylene oxide (e.g., ethylene oxide, propylene oxide, butylene oxide, etc.) having two to about 20 carbon atoms, preferably 2 to about 4. Examples of polyhydric amines include tri-(hydroxypropyl)armine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine.

Among the preferred amines making up b(ii) are the alkylene polyamines, including the polyalkylene polyamines. In another embodiment, the polyamine may be a hydroxyamine provided that the polyamine contains at least one condensable —N—H group.

Preferred polyamine reactants include triethylenetetramine (TETA), tetraethylenepentamine (TEPA), pentaethylenehexamine (PEHA), and mixtures of polyamines such as the above-described "amine bottoms".

Preferred combinations of reactants for making the polyamine product include those in which reactant (b-i) is a polyhydric alcohol having three hydroxyl groups or an amino alcohol having two or more hydroxy groups and reactant (b-ii) is an alkylene polyamine having at least two primary nitrogen atoms and wherein the alkylene group contains 2 to about 10 carbon atoms.

The reaction is conducted in the presence of an acid catalyst at an elevated temperature. Catalysts useful for the purpose of this invention include mineral acids (mono, di- and poly basic acids) such as sulfuric acid and phosphoric acid; organophosphorus acids and organo sulfonic acids, alkali and alkaline earth partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; $CaHPO_4$, $CaSO_4$ and $MgHPO_4$; also $Al_2O_3$ and Zeolites. Phosphorus and phosphoric acids and their esters or partial esters are preferred because of their commercial availability and ease of handling. Also useful as catalysts are materials which generate acids when treated in the reaction mixture, e.g., triphenylphosphite. Catalysts are subsequently neutralized with a metal-containing basic material such as alkali metal, especially sodium, hydroxides.

The reaction to form the polyamine products is run at an elevated temperature which can range from 60° C. to about 265° C. Most reactions, however, are run in the 220° C. to about 250° C. range. The reaction may be run at atmospheric pressure or optionally at a reduced pressure. The degree of condensation of the resultant high molecular weight polyamine prepared by the process is limited only to the extent to prevent the formation of solid products under reaction conditions. The control of the degree of condensation of the product of the present invention is normally accomplished by limiting the amount of the condensing agent, i.e., the hydroxyalkyl or hydroxy aryl reactant charged to the reaction. The resulting product frequently contains the neutralized catalyst and significant amounts by weight, from about 0.1%, often at least 1%, frequently 5% up to 20%, often up to 10%, water.

The amine condensates and methods of making the same are described in Steckel (U.S. Pat. No. 5,053,152) which is incorporated by reference for its disclosure to the condensates and methods of making.

The preparation of various polyamine products is illustrated in the following examples. All percentages and all parts are by weight unless otherwise clearly indicated. Temperatures are in degrees Celsius. Filtrations are conducted using a diatomaceous earth filter aid.

EXAMPLE C-1

A reactor is charged with 1000 parts of an ethylene polyamine bottoms identified as HPA-X (Union Carbide) and 613 parts of 40% aqueous trishydroxymethylaminomethane (THAM). An $N_2$ purge is started and is maintained throughout processing. The materials are heated to 49° C. whereupon 15.9 parts 85% aqueous phosphoric acid are added and the temperature is increased to 177° C. Conditions are adjusted to enable condensation and reflux of the amine while allowing water to be removed from the system. The temperature is then increased to 227° C. and is held at 227–232° C. for 10 hours while refluxing the amines. The mixture is then stripped by heating at 232–238° C. for 6 hours, then is rapidly cooled to 93° C. whereupon 127 parts water are added followed by the addition of 22.1 parts 50% aqueous NaOH. The batch is mixed for 4 hours at 88–93° C. The unfiltered product contains 27% N, 0.35% P, and 11% $H_2O$.

EXAMPLE C-2

A 4 necked, 500-ml, round-bottom flask equipped with glass stirrer, thermowell, subsurface $N_2$ inlet, Dean-Stark trap, and Friedrich condenser is charged with 201 parts of tetraethylenepentamine (TEPA), 151 parts of 40% aqueous THAM, and 3.5 parts of 85% $H_3PO_4$. The mixture is heated to 120° C. over 1.0 hour. With $N_2$ sweeping, the mixture is heated to 130° C. over 1 hour and to 2300° C. over 2 hours more. The temperature is maintained at 230°–240° C. for 4 hours and at 241°–250° C. for 3 hours. The materials are cooled to 150° C. and filtered.

EXAMPLE C-3

A 4 necked, 3-1, round-bottom flask equipped with glass stirrer, thermowell, subsurface $N_2$ inlet, Dean-Stark trap, and Friedrich condenser is charged with 1299 parts HPA Taft Amines (amine bottoms), 727 parts 40% aqueous tris (hydroxymethyl)-aminomethane, heated to 60° C. whereupon 23 parts 85% $H_3PO_4$ are added. The mixture is heated to 120° C. over 0.6 hr. With $N_2$ sweeping, the mixture is heated to 150° C. over 1.25 hr and to 235° C. over 1 hr. more. The materials are held at 230°–235° C. for 5 hours. The temperature is increased to 240° C. over 0.75 hour and is held at 240°–245° C. for 5 hour. The materials are cooled to 150° C. and filtered. Yield: 84%.

EXAMPLE C-4

A 3-liter flask equipped with stirrer, thermowell, below surface $N_2$ inlet and a stripping condenser is charged with 363 parts of THAM and 1200 parts of TEPA. Next are added 16 parts of $H_3PO_4$ at 110° C. $N_2$ blowing is commenced at 120 cc/min. The mixture is heated to 220° C. in 0.8 hour and held at 220°–225° C. for 1.2 hour; then heated to 230° C. in 0.2 hour and held at 230° C. for 4.75 hours: 129 parts distillate collected. The mixture is held at 242°–245° C. for 5 hours: 39 parts additional distillate is collected. Temperature is maintained at 246°–255° C. for 1.2 hr: 178 parts material in trap. The mixture is filtered at 155° C.

EXAMPLE C-5

A 3-liter flask equipped with stirrer, thermowell, below surface $N_2$ inlet and a stripping condenser was charged with 363 parts THAM and 1200 parts TEPA. At 100° C. are added 16 parts $H_3PO_4$. $N_2$ blowing is commenced at 95 cc/min. The mixture is heated to 165° C. in 0.4 hour; and to 241° C. in 0.6 hour, then held at 241°–243° C. for 0.3 hour. The contents are further heated to 250° C. for an additional 0.5 hour and held at 250° C. for 5.5 hour: 288 parts distillate are collected in the trap. Materials are filtered at 150° C.

EXAMPLE C-6

A 1-liter flask equipped with stirrer, thermowell, below surface $N_2$ inlet and Dean-Stark trap was charged with 121 parts THAM and 400 parts TEPA. To this mixture are added 8.2 parts of $KH_2PO_4$ at 60° C. $N_2$ blowing is commenced at 70 cc/min. The reaction mixture is heated to 150° C. over 1 hour, and to 230° C., over 1.5 hours. The temperature is held at 230° C.–232° C. for 4.25 hour: 17 parts material collected in trap. The mixture is held at 237° C. for 3.25 hour: 38 parts material collected in trap. The mixture is further heated to 241° C. over 0.75 hour and is held at 241° C.–242° C. for 4.75 hour; 50 parts material collected in trap. The material is held at 250° C. for 5 hour; total of 53 parts material collected in trap. Filter at 150° C.

EXAMPLE C-7

To a 500 ml flask equipped with stirrer, thermowell, below surface $N_2$ inlet and Dean-Stark trap is charged with 201 parts TEPA and 468 parts glycerol. 2.3 parts $H_3PO_4$ are added at 80° C. $N_2$ blowing is commenced at 165 cc/min. The mixture is heated to 220° C. over 2 hours; to 240° C. in 1 hour; to 245° C. in 1.5 hour and to 255° C. in 1 hour. The temperature is held at 255°–252° C. for 2 hours: 12 parts material collected in trap. The mixture is held at 255°–262° C. for 7 hours: 34 parts distillate collected in trap. The temperature of the mixture is held at 255°–260° C. for 1 hour more. A total of 36 parts distillate is collected in trap. Filter at 130° C.

EXAMPLE C-8

To a 500 ml flask equipped with stirrer, thermowell, below surface $N_2$ inlet and Dean-Stark trap are charged 201 parts TEPA and 45 parts hexaglycerol. To this mixture 3.5 parts $H_3PO_4$ are added at 85° C. $N_2$ blowing is commenced at 165 cc/min. The mixture is heated to 245° C. over 0.7 hour and held at 245°–260° C. for 1.75 hour. The mixture is held at 260°–270° C. for 7.5 hour: total of 27 parts material collected in trap. Filter at 125° C.

EXAMPLE C-9

The procedure of Example C-1 is repeated replacing (THAM) with an equivalent amount, based on —OH, of dibutylaminoethanol.

Acylated nitrogen compositions prepared by reacting the acylating reagents of this invention with an amine as described above are post-treated by contacting the acylated nitrogen compositions thus formed (e.g., the carboxylic derivative compositions) with one or more post-treating reagents selected from the group consisting of boron oxide, boron oxide hydrate, boron halides, boron acids, esters of boron acids, carbon disulfide, sulfur, sulfur chlorides, alkenyl cyanides, carboxylic acid acylating agents, aldehydes, ketones, urea, thio-urea, guanidine, dicyanodiamide, hydrocarbyl phosphates, hydrocarbyl phosphites, hydrocarbyl thiophosfides, phosphorus oxides, phosphoric acid, hydrocarbyl thiocyanates, hydrocarbyl isocanates, hydrocarbyl isothiocyanates, epoxides, episulfides, formaldehyde or formaldehydeproducing compounds plus phenols, and sulfur plus phenols. The same post-treating reagents are used with carboxylic derivative compositions prepared from the acylating reagents of this invention and a combination of amines and alcohols as described above. However, when the carboxylic derivative compositions of this invention are derived from alcohols and the acylating reagents, that is, when they are acidic or neutral esters, the post-treating reagents are usually selected from the group consisting of boron oxide, boron oxide hydrate, boron halides, boron acids, esters of boron acids, sulfur, sulfur chlorides, phosphorus sulfides, phosphorus oxides, carboxylic acid acylating agents, epoxides, and episulfides.

Since post-treating processes involving the use of these post-treating reagents is known insofar as application to reaction products of high molecular weight carboxylic acid acylating agents of the prior art and amines and/or alcohols, detailed descriptions of these processes herein is unnecessary. In order to apply the prior art processes to the carboxylic derivative compositions of this invention, all that is necessary is that reaction conditions, ratio of reactants, and the like as described in the prior art, be applied to the novel carboxylic derivative compositions of this invention. U.S. Pat. No. 4,234,435 is incorporated herein by reference for disclosure of post-treating dispersants formed from the reactions of (D) with amines, alcohols and metalic compositions as described hereinabove.

THE PROCESS

In another embodiment, the present invention relates to a process comprising reacting the reaction products of (A) and (B) to produce (A) an olefin-carboxylic adduct, represented by formulas (IV) and (VI) said reacting being optionally acid catalyzed. The olefin-carboxylic adducts (C) are further reacted with an α-β unsaturated acid or anhydride to produce a substituted acylating agent (D) said reacting being either direct alkylation by a thermal process or a radical initiated process. Reaction processes and more detailed descriptions of (A) and (B) are given in the three European patent applications referenced above which are incorporated herein by reference.

The Catalyst

The process of this invention of reacting (A) and (B) may be conducted in the presence of an acidic catalyst; however, no catalyst is required.

However, when catalysts are used, yields are sometimes enhanced. Acid catalysts, such as organic sulfonic acids, for example, paratoluene sulfonic acid, methane sulfonic acid, heteropolyl acids, the complex acids of heavy metals (e.g., Mo, W, Sn, V, Zr, etc.) with phosphoric acids (e.g., phosphomolybdic acid), and mineral acids, such as sulfuric acid and phosphoric acid. Lewis acids, e.g., $BF_3$, $AlCl_3$ and $FeCl_3$, are useful for promoting "ene" reactions.

When they are used, catalysts are used in amounts ranging from about 0.01 mole % to about 10 mole %, more often from about 0.1 mole % to about 2 mole %, based on moles of olefinic reactant.

For detailed descriptions of the olefin (A), carboxylic reactants (B) and olefin-carboxylic adducts (C) from their reactions refer to the European Patent Applications EP 0759443, 0759444 and 0759435 referred to above and incorporated herein by reference.

(A) The Olefinic Compound

The olefinic compound (A) employed as a reactant in the process of this invention has the general formula $$(R^1)(R^2)C{=}C(R^6)(CH(R^7)R^8)) \quad (I)$$

wherein each of $R^1$ and $R^2$ is, independently, hydrogen or a hydrocarbon based group and each of $R^6$, $R^7$ and $R^8$ is, independently, hydrogen or a hydrocarbon based group provided that at least one is a hydrocarbon based group containing at least 7 carbon atoms. These olefinic compounds are diverse in nature.

Virtually any compound containing an olefinic bond may be used provided it meets the general requirements set forth hereinabove for (I) and does not contain any functional groups (e.g., primary or secondary armines) that would interfere with the reaction with the carboxylic reactant (B). Useful olefinic compounds may be terminal olefins, i.e., olefins having a $H_2C{=}C<$ group, or internal olefins. Useful olefinic compounds may have more than one olefinic bond, i.e., they may be dienes, trienes, etc. Most often, they are mono-olefinic. Examples include linear α-olefins, cis- or trans-disubstituted olefins, trisubstituted and tetrasubstituted olefins.

When (A) is a mono-olefin, one mole of (A) contains one equivalent of C=C; when (A) is a di-olefin, one mole of (A) contains 2 equivalents of C=C bonds; when (A) is a tri-olefin, one mole of (A) contains 3 equivalents of C=C bonds, and so forth.

Aromatic double bonds are not considered to be olefinic double bonds within the context of this invention.

As used herein, the expression "polyolefin" defines a polymer derived from olefins. The expression "polyolefinic" refers to a compound containing more than one C=C bond.

Among useful compounds are those that are purely hydrocarbon, i.e., those substantially free of non-hydrocarbon groups, or they may contain one or more non-hydrocarbon groups as discussed in greater detail herein.

In one preferred embodiment, at least one R is derived from polybutene, that is, polymers of $C_4$ olefins, including 1-butene, 2-butene and isobutylene. Those derived from isobutylene, i.e., polyisobutylenes, are especially preferred.

In another preferred embodiment, R is derived from polypropylene. In another preferred embodiment, R is derived from ethylene-alpha olefin polymers, particularly ethylene-propylene polymers and ethylene-alpha olefin-diene, preferably ethylene-propylene-diene polymers. Molecular weights of such polymers may vary over a wide range but especially those having number average molecular weights ($\overline{M}_n$) ranging from about 300 to about 20,000, preferably 700 to about 5,000. In one preferred embodiment the olefin is an ethylene-propylene-diene terpolymer having $\overline{M}_n$ ranging from about 900 to about 20,000. An example of such materials are the Trilene® polymers marketed by the Uniroyal Company, Middlebury, Conn., USA. Terpolymers are those olefin copolymers in which one of the olefins reacted is a diene.

A preferred source of hydrocarbyl groups R are polybutenes obtained by polymerization of a $C_4$ refinery stream having a butene content of 35 to 75 weight percent and isobutylene content of 15 to 60 weight percent in the presence of a Lewis acid catalyst such as aluminum trichloride or boron trifluoride. These polybutenes contain predominantly (greater than 80% of total repeating units) isobutylene repeating units of the configuration

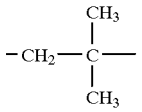

These polybutenes are typically monoolefmic, that is, they contain but one olefinic bond per molecule.

The olefinic compound may be a polyolefin comprising a mixture of isomers wherein from about 50 percent to about 65 percent are tri-substituted olefins wherein one substituent contains from 2 to about 500 carbon atoms, often from about 30 to about 200 carbon atoms, more often from about 50 to about 100 carbon atoms, usually aliphatic carbon atoms, and the other two substituents are lower alkyl.

When the olefin is a tri-substituted olefin, it frequently comprises a mixture of cis- and trans-1-lower alkyl, 1-(aliphatic hydrocarbyl containing from 30 to about 100 carbon atoms), 2-lower alkyl ethylene and 1,1-di-lower alkyl, 2-(aliphatic hydrocarbyl containing from 30 to about 100 carbon atoms) ethylene.

In one embodiment, the monoolefinic groups are vinylidene groups, i.e., groups of the formula $$CH_2{=}{<}C$$

although the polybutenes may also comprise other olefinic configurations.

In one embodiment the polybutene is substantially monoolefinic, comprising at least about 30 mole %, preferably at least about 50 mole % vinylidene groups, more often at least about 70 mole % vinylidene groups. Such materials are described as high vinylidene polybutenes. A conventional polyolefin or polybutene will have only in the range of about 5 mole % vinylidene groups and methods for preparing them are described in U.S. Pat. Nos. 5,286,823 and 5,408,018, which are expressly incorporated herein by reference. They are commercially available, for example under the tradenames Ultravis (BP Chemicals) and Glissopal (BASF).

As is apparent from the foregoing, olefins of a wide variety of type and molecular weight are useful for preparing the compositions of this invention. Useful olefins are usually substantially hydrocarbon and have number average molecular weight ($\overline{M}_n$) ranging from about 100 to about 70,000, more often from about 300 to about 20,000, even more often from about 300 to about 5,000 and frequently from about 1,300–5,000.

The carboxylic reactant (B) is at least one member selected from the group consisting of compounds of the formula (II):

$$R^3C(O)(R^4)_nC(O)OR^5 \qquad \text{(II)}$$

and compounds of the formula (III):

(III)

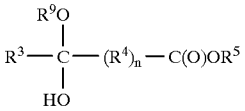

wherein each of $R^3$, $R^5$ and $R^9$ is independently H or a hydrocarbyl group, $R^4$ is a divalent hydrocarbylene group, and n is 0 or 1. Specific embodiments of the groups $R^3$ and $R^5$ are set forth hereinabove where corresponding groups in the compounds (IV) or (VI) are described. $R^9$ is preferably H or lower alkyl.

Examples of carboxylic reactants (B) are glyoxylic acid, glyoxylic acid methyl ester hemiacetal, carboxy aromatic aldehydes, such as 4-carboxybenzaldehyde, and other omega-oxoalkanoic acids, keto alkanoic acids such as pyruvic acid, levulinic acid, ketovaleric acids, ketobutyric acids and numerous others. The skilled worker, having the disclosure before him, will readily recognize the appropriate compound of formula (III) to employ as a reactant to generate a given intermediate. Preferred compounds of formula (III) are those that will lead to preferred compounds of formula (I).

Reactant (B) may be a compound of the formula (VIII)

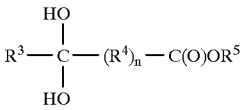

wherein each of $R^3$ and $R^5$ is independently H or hydrocarbyl preferably H or alkyl. Such compounds arise when the carboxylic reactant is hydrated. Glyoxylic acid monohydrate is a representative example. A preferred reactant is glyoxylic acid methyl ester methyhemiacetal.

From the foregoing, it is apparent that the various 'R' groups in the products (IV) and (VI) correspond to the same groups in the olefinic and carboxylic reactants.

The process of this invention for reacting (A) and (B) to produce (C) olefin-carboxylate adducts is conducted at temperatures ranging from ambient up to the lowest decomposition temperature of any of the reactants, usually from about 60° C. to about 220° C., more often from about 120° C. to about 160° C. When the reaction is conducted in the presence of organic sulfonic acid or mineral acid catalyst, the reaction is usually conducted at temperatures up to about 150° C., often up to about 120° C., frequently from about 120° C. up to about 130° C. The process employs from about 0.6 moles of reactant (B) per equivalent of (A), to about 3.0 moles (B) per equivalent of (A), more often from about 0.8 moles (B) per equivalent of (A) to about 1.5 moles (B) per equivalent of (A), even more often from about 0.95 moles (B) per equivalent of (A) to about 1.05 moles (B) per equivalent of (A). In order to maximize yield of product of this invention, it is generally desirable to conduct the reaction at as low a temperature as possible. As noted herein, some reactants contain water which is removed. Removal of water at moderate temperatures is attainable employing reduced pressure, a solvent that aids in azeotropic distillation of water, or by purging with an inert gas such as $N_2$.

The progress of the reaction can be followed by observing the infra-red spectrum. The absorption for —COOH carbonyl of the products appears at about 1710 $cm^{-1}$. The total acid number as measured using essentially the procedure in ASTM D-664 (Potentiometric Method) or ASTM D-974 (Color Indicator Method) is useful together with the infrared, keeping in mind that non-acidic products (e.g., polyester products), those derived from non-acidic reactants and condensation products such as lactones will not display significant acid numbers. However, ASTM method D-94 measures SAP (saponification number) of carboxylic materials whether such materials are acidic or not.

These procedures appear in the Annual Book of ASTM Standards, Volume 05.01, ASTM, 1916 Race Street, Philadelphia, Pa., USA.

The following examples are intended to illustrate several compositions of this invention as well as means for preparing same. Unless indicated otherwise, all parts are parts by weight. It is to be understood that these examples are intended to illustrate several compositions and procedures of the invention and are not intended to limit the scope of the invention.

For the synthesis of the reaction products (C) formed by reacting (A) and (B), the preferred reactants for (A) are high vinylidine polyisobutylenes having $\overline{M}_n$ in the range of about 900–1,100 and 1900–2,400 or mixtures thereof. These values are approximate. The preferred reactants for (B) are glyoxylic acid and the glyoxylic acid in its hydrated form and glyoxylic acid methyl ester methylhemiacetal. These reaction products (C) are then further reacted with the α-β unsaturated acid or anhydride to produce the substituted acylating agent (D).

Example 1 (For Product (C))

Five thousand two hundred seventy-five grams (5.275 moles) of Ultravis 10 (BP Chemicals), 759.6 grams glyoxylic acid methyl ester methyl hemiacetal (6.33 moles) (Chemie Linz), 20 grams 70% aqueous methane sulfonic acid together with a few drops of an antifoamer were charged to a 12 liter four necked flask fitted with a subsurface nitrogen inlet (0.2 cfh), thermowell and Dean Stark trap fitted with a condenser.

The reaction was held for 6 hours at 135° C. while collecting distillate. The reaction mixture was allowed to cool and stand overnight, then heated to 135° C. and vacuum stripped, then filtered at 135° C. through diatomaceous earth filter aid.

Example 1A (For Product (C))

A reactor is charged with 3,000 parts of a polyisobutene having a number average molecular weight of about 100 and which contains about 80 mole % terminal vinylidene groups and 6 parts 70% aqueous methansulfonic acid. The materials are heated to 160° C. under N2 followed by addition of 577.2 parts 50% aqueous glyoxylic acid over 4 hours while maintaining 155–160° C. Water is removed and is collected in a Dean-Stark trap. The reaction is held at 160° C. for 5 hours, cooled to 140° C. and filtered with a diatomaceous earth filter aid. The filtrate has total acid no.=34.7 and saponification no.=53.2.

Example 1B (For Product (C))

A reactor is charged with 300 parts of polyisobutene (CE 5203, BASF) having $\overline{M}$n of about 1,00 and containing about 49 mole % terminal vinylidene groups, 88.8 parts 50% aqueous glyoxylic acid and 1 part sulfuric acid and a few drops of silicone antifoam agent. Under N2, the materials are heated to 100° C. and held at 100° C. for 1 hour, then to 125° C. and held at 125° C. for 2 hours, then heated to 150° C. and maintained at 150° C. for 3 hours, collecting a total of 49 parts distillate in a Dean-Stark trap. The materials are filtered at 150° C. with a diatomaceous earth filter aid.

Example 2 (For Substituted Carboxylic Acylating Agent (D))

The Ultravis 10 glyoxylic methyl ester methyl hemiacetal reaction product from Example 1, 350 grams (0.41 moles based on equivalent weight of 846 as determined by SAP number) and 98.1 grams 0.61 moles maleic anhydride were charged into a 4 necked flask fitted with a reflux condenser, thermowell, and Nitrogen inlet (0.3 cfh) and heated to 215° C. The reaction was held for a total of 14 hours at 215° C. then stripped for two hours at 10 mm Hg, cooled to 140° C. and filtered through 1% by weight of diatomaceous earth to yield the product represented by formula (VIII).

Example 2A (For Substituted Carboxylic Acylating Agent (D))

The procedure for Example 2 is repeated except the olefin carboxylic adduct from Example 1 is replaced on an equimolar basis by the carboxylic adduct from Example 1A.

Example 2B (For Substituted Carboxylic Acylating Agent (D))

The procedure for Example 2 is repeated except the olefin carboxylic adduct from Example 1 is replaced on an equimolar basis by the carboxylic adduct from Example 1B.

Example 3 (Polyamine Derivatives of (D))

Into a four-necked flask was charged the substituted carboxylic acylating agent of Example 2, 215 grams (0.46 equivalents, equivalent weight of 456 determined by SAP number) and 28.2 grams (0.71 equivalents of 40.11 equivalent weight) polyamine and 162.2 grams 100N diluent oil under nitrogen gas. The flask is fitted with a thermowell and Dean Stark trap and condenser. The polyamine is PM 1969 available from Union Carbide and is 74% polyamine bottoms and 26% diethylenetriamine. The reaction is heated for 6 hours at 160° C., cooled to 140° C. and filtered through 1% by weight diatomaceous earth to give the product as the filtrate.

Example 3A (Polyamine Derivatives of (D))

The procedure for Example 3 is repeated except the substituted carboxylic acylating agent from Example 2 is replaced on an equimolar basis by the substituted carboxylic acylating agent from Example 2A.

Example 3B (Polyamine Derivatives of (D))

The procedure for Example 3 is repeated except the substituted carboxylic acylating agent from Example 2 is replaced on an equimolar basis by the substituted carboxylic acylating agent from Example 2B.

Example 3C (Polyamine Derivatives of (D))

The procedure for Example 3 is repeated except the substituted carboxylic acylating agent from Example 2 is replaced on an equimolar basis by the substituted carboxylic acylating agent from Example 4.

Example 4 (Substituted Carboxylic Acylating Agent (D)

Example 2 above gives a procedure for the thermal reaction of (IV) and (VI) with maleic anhydride. The reaction can also be radical catalyzed by use of di-t-butyl peroxide.

Into a four-necked flask is charged 450 grams of the product of Example 1 (0.532 equivalents, 846.2 molecular weight by SAP number), 17.4 grams (0.177 equivalents) of maleic anhydride, 3.1 grams di-t-butyl peroxide (0.021 moles) together with 300 ml of toluene. The flask is equipped with a Nitrogen purge at 0.2 cfh, a thermowell and a condenser. The mixture was heated to 115° C. and held 7 hours at temperature. After 7 hours a second 17.4 grams (0.177 equivalent) maleic anhydride and 3.1 grams (0.021 mole) Triganox B added heating is continued for 7 hours when another 17.4 grams (0.177 equivalents) maleic anhydride and 3.1 gram (0.021 mole) di-t-butyl peroxide added and heating continued another 7 hours. In total, the equivalents of maleic anhydride is equal to the equivalents of reaction products of (A) and (B) being reacted with maleic anhydride to produce said reaction products.

Those skilled in the art will realize that the chlorine free composition (D) are novel and useful in fuels and lubricants, and that the derivatives of (D) are further useful in fuels and lubricants. For use in fuels, the composition (D) and dispersant derivatives thereof (E) are mixed in any fuel as is known to those skilled in the art at a level of about 5–15,000 parts per million. The compositions (D) and (E) are normally dissolved in a fluidizer to make a concentrate at the level of about 5–95% by weight of (D) or its further reaction products. The fluidizers used are diluent oils and inert stable oleophilic organic solvents boiling in the range of about 150° C. to 400° C. Preferably, for use in fuels an aliphatic or an aromatic hydrocarbon solvent such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 5 percent by weight and generally not exceed 70 percent by weight, preferably from 5 to 50 and more preferably from 10 to 25 weight percent.

The diluent oils suitable for fluidizers are mineral or synthetic oils having kinematic 100° C. viscosity values of about 20 cSt to about 25 cSt. Synthetic oils include but are not limited to polyoxyalkylene mono and polyols, either derivatives thereof and N-vinylpyrrolidinone addition products thereof, polyalpha olefins and hydrogenated polyalpha-olefins.

The substituted carboxylic acylating agents (D) and their further reaction products (E) described hereinabove, and especially amine and polyamine derivatives (E) are mainly utilized in oils of lubricating viscosity. Acylating agents (D) and their derivatives (E) described hereinabove are used in oils at levels of 0.1–20 weight percent on a chemical basis. The oils are well known to those familiar with the art and may be mineral, plant and synthetic oils or mixtures thereof. The carboxylic acylating agents (D) and their further reaction products may be made up in concentrates having 5–95% of (D) or (E) its derivatives on a weight basis in diluent oil. The concentrates may then be added to a selected oil of lubricating viscosity.

We claim our invention as recited in the claims below:

1. A composition of matter, said composition comprising:

(D) substituted carboxylic acylating agents, said acylating agents being formed by (a) reacting an olefin (A) with a carboxylic reactant (B) to produce (C), olefin-carboxylic adducts, wherein the ratio of reactants ranges from about 0.5 moles (B) per equivalent of (A), to about 3 moles (B) per equivalent of (A), and wherein said reacting is optionally acid catalyzed;

(b) further reacting said olefin-carboxylic adducts (C) with from about 0.1–10 moles of an α-β unsaturated acid or anhydride per mole of (C) to form (D) said substituted carboxylic acylating agents.

2. A composition according to claim 1, wherein said olefin-carboxylic adducts (C) is reacted with an α,β-unsaturated acid or anhydride to form (D) under thermal conditions.

3. A composition according to claim 1, wherein said olefin-carboxylic adducts (C) is reacted with an α,β-unsaturated acid or anhydride to form (D) under radical promoted conditions.

4. A composition according to claim 1, wherein said substituted carboxylic acylating agents (D) are further reacted with a reactant selected from the group consisting of (a) ammonia, an amine including hydrazine characterized by the presence within its structure of at least one H—N< group; (b) an alcohol; (c) a reactive metal or reactive metal compound; (d) a combination of two or more of (a) through (c); the components of (d) being reacted with said reaction products simultaneously or sequentially in any order.

5. A composition of claim 4, wherein the substituted carboxylic acylating agent (D) is made under thermal conditions.

6. A composition of claim 4, wherein the substituted carboxylic acylating agent (D) is made under free radical promoted conditions.

7. A composition according to claim 2, wherein said amine is an ethylene polyamine.

8. A composition according to claim 1, wherein said olefin is a polyolefin of $\overline{M}_n$ 300–20,000.

9. A composition according to claim 8, wherein said polyolefin is a polybutene of $\overline{M}$ 300–5,000.

10. A composition according to claim 8, wherein said polyolefin is derived from $C_2$–$C_{28}$ olefins and mixtures thereof.

11. A composition according to claim 8, wherein said polyolefin is a terpolymer.

12. A composition according to claim 10, wherein said polyisobutylene is selected from the group consisting of conventional and high vinylidine polyisobutylene.

13. A composition according to claim 1, wherein said α-β unsaturated compound is maleic acid or maleic anhydride.

14. A composition according to claim 1, wherein said carboxylic reactant (B) is selected from the group consisting of (a) glyoxylic acids and (b) glyoxylic acid methyl ester methyl hemiacetal and mixtures thereof.

15. The composition according to claim 1 or 4 added in a minority amount to a fuel.

16. The composition according to claim 1 or 4 added in a minority amount to an oil of lubricating viscosity.

17. The composition according to claim 1 or 4 added to an inert organic solvent to form a concentrate.

18. The composition according to claim 1 or 2 added to a diluent oil to form a concentrate.

19. A method of making the composition of claim 1, said method comprising reacting an olefin-carboxylic adduct (C) with an α-β unsaturated acid or anhydride to form said substituted carboxylic acylating agent (D).

20. The method according to claim 19 wherein said olefin-carboxylic adduct (C) is formed by reacting an olefin (A) and a carboxylic reactant (B) under thermal conditions and optionally with an acid catalyst.

21. The method according to claim 19 wherein said substituted carboxylic acylating agent (D) is formed by reacting said olefin-carboxylic adduct (C) with an α,β-unsaturated acid or anhydride under thermal conditions.

22. The method according to claim 19 wherein said substituted carboxylic acylating agent (D) is formed by reacting said olefin-carboxylic adduct (C) with an (α,β-unsaturated acid or anhydride under radical initiated conditions.

5,912,213
25 26

* * * * *